US007096516B1

(12) United States Patent
Moore, Jr. et al.

(10) Patent No.: US 7,096,516 B1
(45) Date of Patent: Aug. 29, 2006

(54) ALARMING PLUMBING SCREEN

(76) Inventors: Allen Moore, Jr., 102 Turner Ave., Penns Grove, NJ (US) 08069; John Haddock, 15 S. Elmwood Ave., Carney's Point, NJ (US) 08069

( * ) Notice: Subject to any disclaimer, the term of this patent is extended or adjusted under 35 U.S.C. 154(b) by 0 days.

(21) Appl. No.: 11/302,616

(22) Filed: Dec. 15, 2005

(51) Int. Cl.
*E03D 9/00* (2006.01)

(52) U.S. Cl. ..... 4/256.1; 4/286

(58) Field of Classification Search ..... 4/286, 4/289–292, 256.1, DIG. 14
See application file for complete search history.

(56) References Cited

U.S. PATENT DOCUMENTS 2,617,996 A * 11/1952 Hoffman et al. ..... 4/256.1
4,985,944 A 1/1991 Shaw
5,027,447 A 7/1991 Pino
5,251,339 A 10/1993 Piskula
5,771,501 A 6/1998 Shaw
6,336,233 B1 1/2002 Shaw et al.
6,721,965 B1 * 4/2004 Alston ..... 4/256.1
6,769,443 B1 8/2004 Bush
6,880,178 B1 4/2005 Pino

* cited by examiner

*Primary Examiner*—David J. Walczak
*Assistant Examiner*—Huyen Le
(74) *Attorney, Agent, or Firm*—John D. Gugliotta

(57) ABSTRACT

A plumbing screen is provided having an annular seal that is adapted to fittingly conform to the internal surface of a toilet drain. The annular seal circumscribes a central screen that provides free fluid communication down the toilet drain but provides physical impingement for obstructions. At least one contact switch is located in the outer seal wall and controls an annunciator module that will provide an audible alarm upon removing the contact between the switch and the toilet sidewall. This audible alarm will indicate tampering with or removal of the screen.

6 Claims, 3 Drawing Sheets

ALARMING PLUMBING SCREEN

RELATED APPLICATIONS

The present invention contains subject matter that was first described in Disclosure Document Registration 582,021 filed on Jul. 14, 2005 under 35 U.S.C. §122 and 37 C.F.R. §1.14. As such, it is respectfully requested that said Disclosure Document remain a permanent part of the file history of the present application and be relied upon during the pending prosecution, and for any other matters that may arise.

There are no previously filed, nor currently any co-pending applications, anywhere in the world.

BACKGROUND OF THE INVENTION

1. Field of the Invention

The present invention relates generally to plumbing systems and, more particularly, to a device particularly adapted to discourage disposal of undesired items through toilet drains 2. Description of the Related Art As is well known in the art, there are many systems that have been developed for preventing the disposal of contraband down toilet drains. The systems available in the prior art generally fall into two broad categories: electronic controls systems that provide integrated systems for controlling drainage via allowing or preventing activation of the feed components (toilets, sinks, etc.); and, static hooks or grappling devices strategically placed within the plumbing systems designed to capture contraband or undesired objects before they can cause blockages, backups, or obstructions that can cause larger problem.

A general search of the prior art did not disclose any patents that read directly on the claims of the instant invention; however, the following references were found that exemplify solutions that can be exemplary of these categories.

Of the electronic control types of systems, U.S. Pat. Nos. 4,985,944 and 5,771,501, issued in the name of Shaw, and U.S. Pat. No. 6,336,233, issued in the name of Shaw et al., all show electronic control systems that provide operational interlocks controlled by a central control unit. The '944 reference further elucidates additional safety delays incorporated into the control system to coordinate with multiple toilets to prevent a large number of simultaneous flushes that would otherwise cause a surge that could overwhelm the entire system. In the '501 and '233 references, a more complex design is taught that would appear to require a tremendous amount of integration or having such a system designed within a new construction facility in order to be implemented. Also, U.S. Pat. No. 6,769,443, issued in the name of Bush, describes a plumbing control system that incorporates a controller having a use setpoint for each valve actuator that tracks excess usage and disallows activation if the setpoint is exceeded.

Of the static hook/grappling designs, U.S. Pat. No. 5,251,330, issued in the name of Piskula, discloses a fishhook mounted to a removable plug and inserted into the plumbing. By removing the plug, a user can retrieve the hook and any snagged or attached articles thereto. Further, U.S. Pat. Nos. 5,027,447 and 6,880,178, both issued in the name of Pino, both disclose a retractable hook or grapple that are installed strategically in the pluming piping system in order to interact with contraband inserted into the system. The '178 reference further shows a spring loaded system that can indicate an obstruction visually without opening the piping to inspect.

Consequently, a need has been felt for providing an apparatus and method of providing contraband screening for toilets that does not required specially design, specifically installed or retrofitting to the toilets or plumbing of the facility.

SUMMARY OF THE INVENTION

It is therefore an object of the present invention to provide an improved plumbing screen for preventing unauthorized objects from being discharged via toilets.

It is a feature of the present invention to provide an improved a plumbing screen that is passively operated but provides an audible alarm if tampered with.

Briefly described according to one embodiment of the present invention, a plumbing screen is provided having a annular seal that is adapted to fittingly conform to the internal surface of a toilet drain. The annular seal circumscribes a central screen that provides free fluid communication down the toilet drain but provides physical impingement for obstructions. At least one contact switch is located in the outer seal wall and controls an annunciator module that will provide an audible alarm upon removing the contact between the switch and the toilet sidewall. This audible alarm will indicate tampering with or removal of the screen.

An advantage of the present invention is that it can be used with any conventional toilet without modification or customization to the plumbing system.

Another advantage of the present invention is that it provides an audible alarm to indicate tampering.

Further, a preferred embodiment of the present invention is inexpensive to make, easy to install and use, does not require complicated plumbing changes, and can be used in with a variety of individual or institutional facilities.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
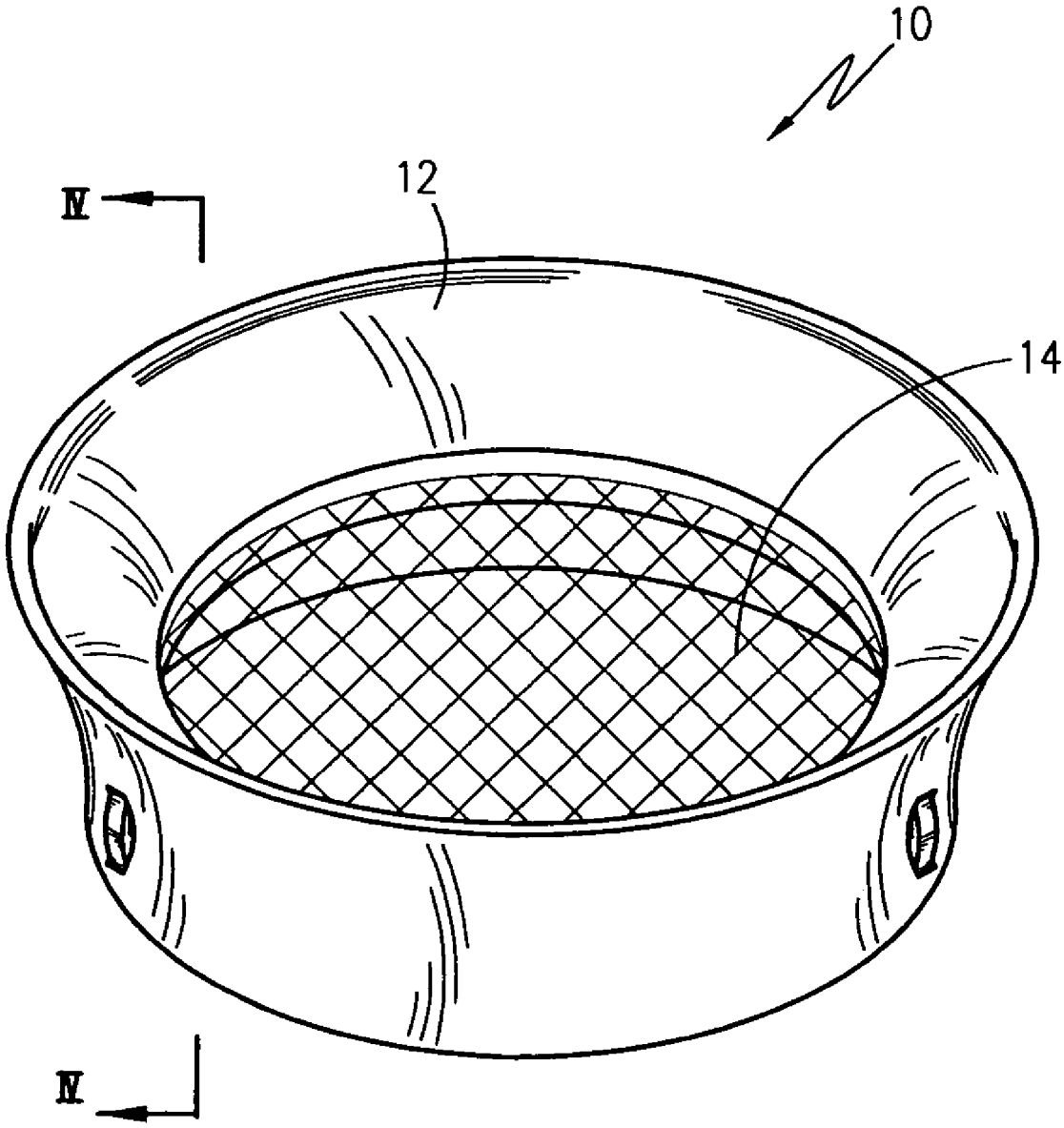
FIG. 1 is a perspective view of an alarming plumbing screen according to the preferred embodiment of the present invention.
Figure 2:
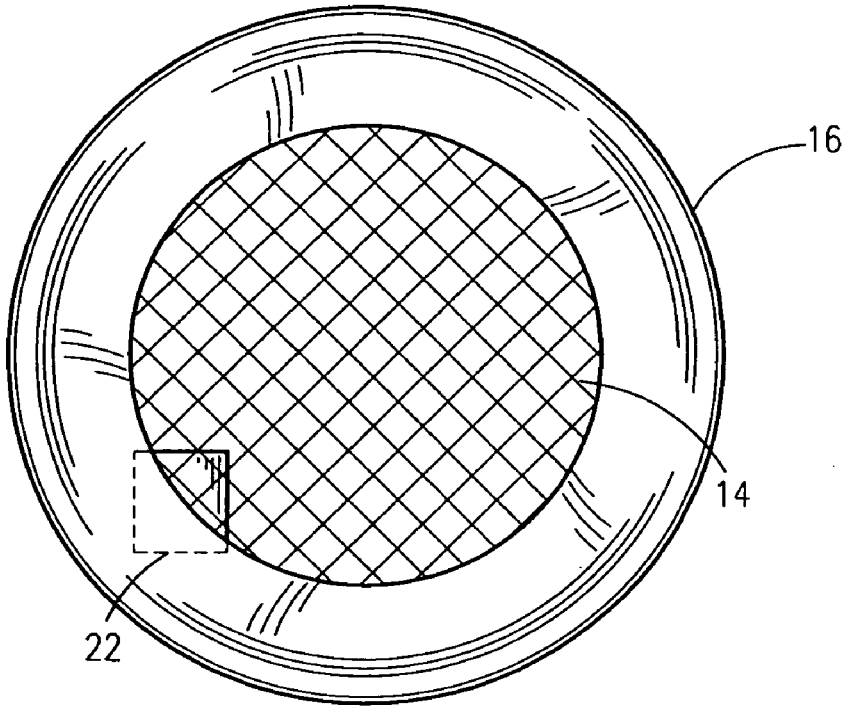
FIG. 2 is a top plan view thereof.
Figure 3:
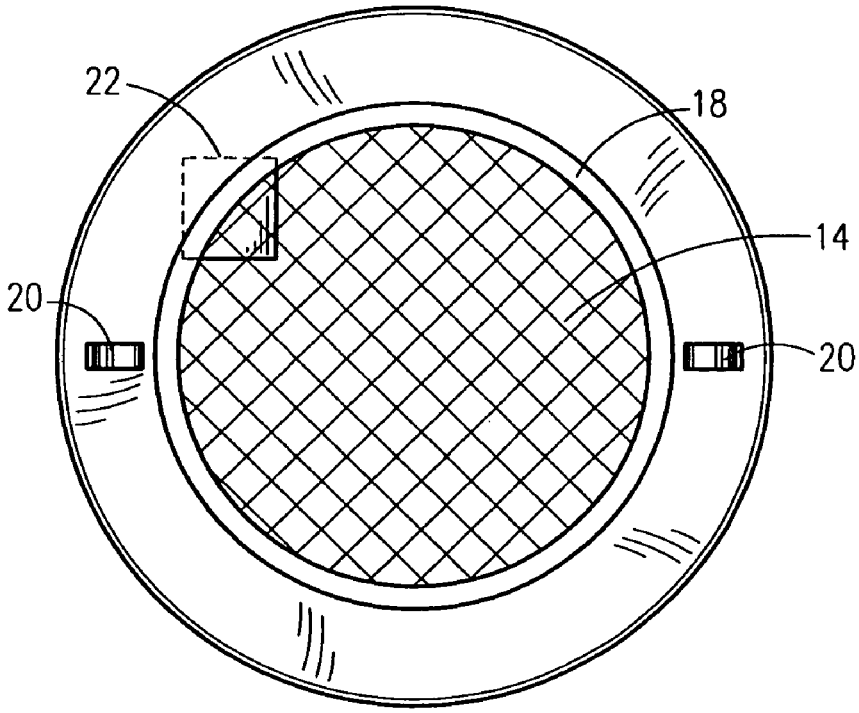
FIG. 3 is a bottom plan view thereof.
Figure 4:
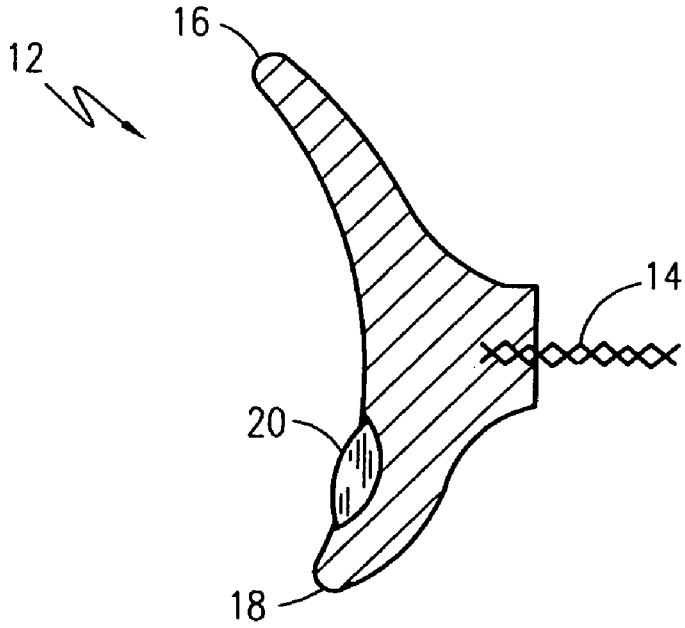
FIG. 4 is a cross sectional view taken along line IV—IV of FIG. 1.

The best mode for carrying out the invention is presented in terms of its preferred embodiment, herein depicted within the Figures 1. Detailed Description of the Figures Referring now to FIGS. 1–5, a plumbing screen 10 is shown, according to the present invention, according to one exemplary embodiment of the present invention. The plumbing screen 10 is provided having a annular seal 12 that is adapted to fittingly conform to the internal surface of a toilet drain "D". The annular seal 12 circumscribes and retains a central screen 14 that provides free fluid communication down the toilet drain but provides physical impingement for obstructions.

In greater detail, the annular seal 12 is formed having an upper peripheral rim 16 that is cantilevered offset from a lower peripheral rim 16 such as to form a slightly concave, inwardly directed sidewall 18. This sidewall 18 is adapted to fittingly conform to the inner surface of the toilet drain sidewall. Further, the seal 12 is anticipated as being formed of a reasonably pliable material, such as rubber, elastomer, or silicone, to allow for flexible insertion in and retention within the toilet.

At least one contact switch 20 is located in the outer seal sidewall 18 and controls an annunciator means 22, shown herein as an audible alarm module that will provide an audible alarm upon removing the contact between the switch 20 and the toilet sidewall "D". This audible alarm will indicate tampering with or removal of the screen.

2. Operation of the Preferred Embodiment

Figure 5:
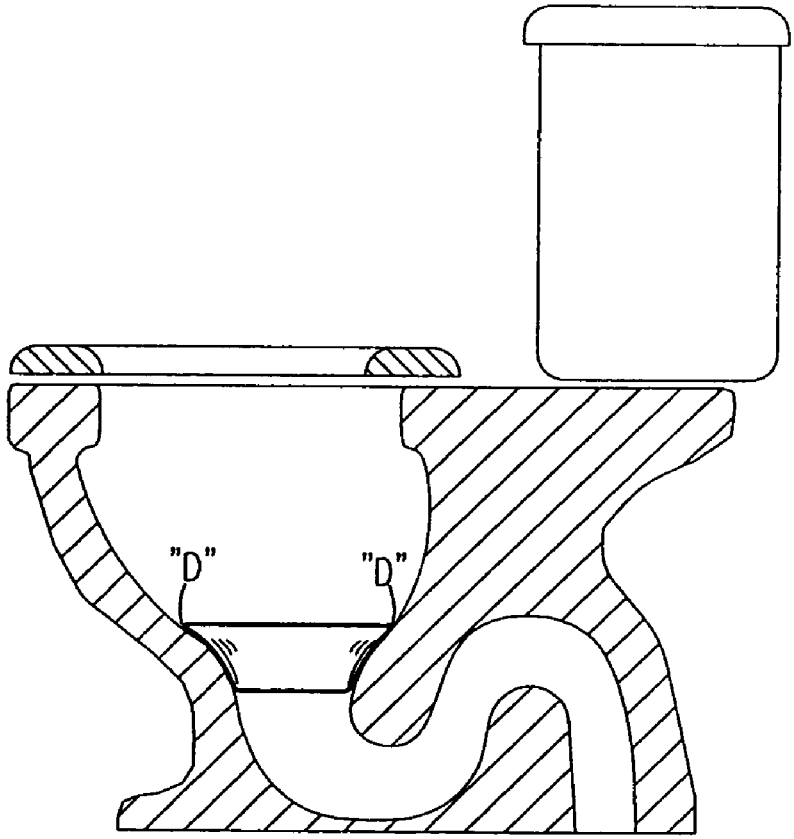
FIG. 5 is a partial sectional view of an otherwise conventional toilet shown in use with an alarming plumbing screen of the present invention.

In accordance with a preferred embodiment of the present invention, as shown in FIG. 5, to use the present invention a user will simply place the screen 10 into the drain D of the toilet in a manner that seals the outer seal 12 against the sidewall, and positioned such that any and all switches 20 are in contact. It is intended that the screen can be easily installed or removed at locations identified as entry points for potential problems that may affect the entire system.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A contraband plumbing screen comprising, in combination:

an annular seal that is adapted to fittingly conform to the internal surface of a toilet drain;

a central screen circumscribed by and retained within said annular seal, said central screen providing free fluid communication down the toilet drain but provides physical impingement for obstructions; and alarm means for annunciating an audible sound upon removal of said annular seal from the internal surface of said toilet drain.

2. The contraband plumbing screen of claim 1, wherein said annular seal is formed having an upper peripheral rim that is cantilevered offset from a lower peripheral rim such as to form a slightly concave, inwardly directed sidewall; wherein said sidewall is adapted to fittingly conform to the inner surface of the toilet drain sidewall.

3. The contraband plumbing screen of claim 2, wherein said seal is formed of a reasonably pliable material.

4. The contraband plumbing screen of claim 3, wherein said seal is formed of a material selected from the group comprising: rubber; elastomer; cork; and, silicone.

5. The contraband plumbing screen of claim 1, where said alarm means comprises:

at least one contact switch located in said outer seal sidewall, said contact switch in electronic communication and control with an audible alarm module; and said audible alarm module.

6. The contraband plumbing screen of claim 5, wherein said contact switch initiates an audible alarm upon removing the contact between said switch and the toilet sidewall.

* * * * *